US010713975B2

(12) United States Patent
Wallen

(10) Patent No.: US 10,713,975 B2
(45) Date of Patent: Jul. 14, 2020

(54) REMOVABLY SECURING A SLICEFORM TO A FOLDABLE ARTICLE

(71) Applicant: Hallmark Cards, Inc., Kansas City, KS (US)

(72) Inventor: Thomas A. Wallen, Merriam, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 0 days.

(21) Appl. No.: 16/425,597

(22) Filed: May 29, 2019

(65) Prior Publication Data

US 2019/0371211 A1 Dec. 5, 2019

Related U.S. Application Data

(60) Provisional application No. 62/678,033, filed on May 30, 2018.

(51) Int. Cl.

| | |
|---|---|
| ***G09F 1/08*** | (2006.01) |
| ***B42D 15/04*** | (2006.01) |
| ***G09F 1/06*** | (2006.01) |

(52) U.S. Cl.
CPC ..... *G09F 1/08* (2013.01); *B42D 15/042* (2013.01); *G09F 1/06* (2013.01)

(58) Field of Classification Search
CPC ..... G09F 1/08; G09F 1/06; B42D 15/042
See application file for complete search history.

(56) References Cited

U.S. PATENT DOCUMENTS

| | | | | |
|---|---|---|---|---|
| 930,108 | A * | 8/1909 | Walcutt | A63H 33/38 446/148 |
| 1,052,187 | A * | 2/1913 | Stranders | G09F 1/06 40/539 |
| 1,194,678 | A * | 8/1916 | Stranders | G09F 1/06 40/539 |
| 3,090,144 | A | 5/1963 | Malamude | |
| 3,235,988 | A | 2/1966 | Paige | |
| 4,349,973 | A * | 9/1982 | Penick | G09F 1/06 40/124.08 |
| 4,833,802 | A | 5/1989 | Volkert | |
| 5,022,681 | A | 6/1991 | Penick | |
| 5,305,705 | A | 4/1994 | Gagliano | |
| 5,450,680 | A | 9/1995 | Bromberg | |
| 5,626,232 | A | 5/1997 | Volkert et al. | |
| 5,682,999 | A | 11/1997 | Larson | |
| 5,738,221 | A | 4/1998 | Van Witt et al. | |

(Continued)

OTHER PUBLICATIONS

International Search Report and Written Opinion dated Jul. 30, 2019 in International Patent Application No. PCT/US2019/034611, 11 pages.

*Primary Examiner* — Gary C Hoge
(74) *Attorney, Agent, or Firm* — Shook, Hardy & Bacon, LLP

(57) ABSTRACT

A foldable article having a sliceform removably secured to one or more panels of the foldable article. A tab having a retaining portion may extend from at least one of the one or more panels of the foldable article. The tab may pass through an opening in the sliceform and the retaining portion may be wider than the width of the opening. The retaining member may be manipulated to pass through the opening to removably secure the sliceform to, and/or detach the sliceform from, the foldable article.

17 Claims, 7 Drawing Sheets

(56) References Cited

U.S. PATENT DOCUMENTS

| | | | | |
|---|---|---|---|---|
| 5,817,378 | A | 10/1998 | Otani | |
| 5,933,989 | A | 8/1999 | Volkert et al. | |
| 5,943,800 | A * | 8/1999 | Rose | G09F 1/06 40/124.08 |
| 6,311,142 | B1 | 10/2001 | Glassner | |
| 6,386,370 | B1 | 5/2002 | Wigton et al. | |
| 6,966,135 | B1 | 11/2005 | McDonald | |
| 7,490,425 | B2 | 2/2009 | Crowell et al. | |
| 7,938,270 | B2 | 5/2011 | Davis | |
| 8,499,478 | B1 | 8/2013 | Glass et al. | |
| 9,475,333 | B2 * | 10/2016 | Yeh | G09F 1/08 |
| 9,524,658 | B1 | 12/2016 | Wise et al. | |
| 9,601,033 | B2 | 3/2017 | Wise et al. | |
| 9,643,443 | B2 | 5/2017 | Bogdanski et al. | |
| 9,842,516 | B2 | 12/2017 | Yeh | |
| 9,873,280 | B1 | 1/2018 | Nelson et al. | |
| 10,339,838 | B2 | 7/2019 | Wise et al. | |
| 2003/0097773 | A1 * | 5/2003 | Oh | G09F 1/06 40/124.08 |
| 2006/0086015 | A1 | 4/2006 | Zlotnick et al. | |
| 2007/0017133 | A1 * | 1/2007 | Crowell | G09F 1/06 40/610 |
| 2007/0293118 | A1 | 12/2007 | Prescott | |
| 2008/0016732 | A1 | 1/2008 | Gardi | |
| 2008/0229633 | A1 | 9/2008 | Yi | |
| 2008/0236000 | A1 | 10/2008 | Bostick | |
| 2012/0285861 | A1 | 11/2012 | Glass et al. | |
| 2013/0139420 | A1 * | 6/2013 | Rubar | G09F 1/06 40/124.08 |
| 2013/0191083 | A1 | 7/2013 | Bachrach et al. | |
| 2016/0358515 | A1 | 12/2016 | Christiansen | |
| 2016/0365009 | A1 * | 12/2016 | Wise | G09F 1/06 |
| 2017/0148358 | A1 | 5/2017 | Wise et al. | |
| 2017/0178544 | A1 | 6/2017 | Yeh | |
| 2018/0102070 | A1 * | 4/2018 | Yeh | B42D 15/045 |

* cited by examiner

REMOVABLY SECURING A SLICEFORM TO A FOLDABLE ARTICLE

CROSS-REFERENCE TO RELATED APPLICATIONS

This application claims priority to U.S. Provisional Application No. 62/678,033, filed May 30, 2018, the disclosure of which is hereby incorporated by reference in its entirety for any and all purposes.

TECHNICAL FIELD

The present invention relates generally to removably securing a sliceform to a foldable article. More particularly, the present invention relates generally to removably securing a sliceform in products that contain two hinged planes that move toward and away from one another, for example, greeting cards, books, invitations, boxes, and other objects with flaps.

BACKGROUND

Technology may be added to a greeting card or the like to make a compelling event occur (for example, expansion of a sliceform from a collapsed state to a three-dimensional state) when a consumer interacts with the greeting card or like object. It would be desirable that a sliceform included in a foldable article be removably secured thereto so as to permit removal of the sliceform from the foldable article. Historically, sliceforms have been permanently affixed to foldable articles. It would also be desirable to have an alternate means of securing a sliceform to a foldable article with a minimum of wasted material and/or without the need for adhesives.

SUMMARY

This summary is provided to introduce a selection of concepts in a simplified form that are further described below in the detailed description section. This summary is not intended to identify key features or essential features of the claimed subject matter, nor is it intended to be used as an aid in determining the scope of the claimed subject matter. The scope of the invention is defined by the claims.

Embodiments of the present invention are directed to systems and methods of removably securing a sliceform to a foldable article. For example, it may be desirable to secure a sliceform within a foldable article (e.g., a greeting card, book, etc.) in a manner such that the sliceform may be removed from the foldable article without damaging the sliceform and/or foldable article and without disassembling the sliceform. Aspects herein provide for securing a sliceform to a foldable article by threading tabs and retaining portions through openings in the sliceform. The retaining portions are sized to restrict movement of the tab through the opening and consequently restrict movement of the sliceform away from the foldable article. The sliceform may be removed from the foldable article by manipulating the retaining portions to a size that may pass back through the opening in the sliceform.

BRIEF DESCRIPTION OF THE SEVERAL VIEWS OF THE DRAWINGS

The present invention is explained in more detail below with reference to the embodiments illustrated in the attached drawing figures, in which like reference numerals denote like elements, in which FIGS. 1-9 illustrate three possible embodiments of the present invention, and in which:

FIG. 1 is a front perspective view of a foldable article in an open position having a sliceform removably secured thereto, in accordance with an embodiment of the present invention;

FIG. 2 is a top view of the sliceform of FIG. 1;

FIG. 3 is a front view of base panels forming a portion of the sliceform of FIG. 1;

FIG. 4 is a front view of vertical panels forming a portion of the sliceform of FIG. 1;

FIG. 5 is a front perspective view of the foldable article of FIG. 1;

FIG. 6 is a front perspective view of an alternative foldable article, in accordance with a second embodiment of the present invention;

FIG. 7 is a detailed perspective view of the third subpanel of FIG. 1;

FIG. 8 is a detailed perspective view of an alternative third subpanel, in accordance with a third embodiment of the present invention;

FIG. 9 is a top view of the sliceform removably secured to the foldable article of FIG. 1 with the foldable article in the open position;

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or a combination of steps similar to the ones described in this document, in conjunction with other present or future technologies.

Embodiments of the present invention are directed to systems comprising a foldable article having a sliceform removably secured to the foldable article and methods of removably securing a sliceform to a foldable article. For example, it may be desirable to secure a sliceform within a foldable article (e.g., a greeting card, book, etc.) in a manner such that the sliceform may be removed from the foldable article without damaging the sliceform and/or foldable article and/or without disassembling the sliceform. Aspects herein provide for securing a sliceform to a foldable article by threading tabs and retaining portions through openings in the sliceform. The retaining portions are sized to restrict movement of the tab through the opening and consequently restrict movement of the sliceform away from the foldable article. The sliceform may be removed from the foldable article by manipulating (e.g., folding, bending, etc.) the retaining portions to a size that allows them to pass back through the opening in the sliceform.

Some aspects of the present invention may be described using relative location terminology. For example, the term "proximate" is intended to mean on, about, near, by, next to, at, and the like. Therefore, when a feature is proximate another feature, it is close in proximity but not necessarily exactly at the described location, in some aspects. The term "substantially" when used in relation to angular orientation means within ±5 degrees of a designated value. Thus, when an element is substantially parallel to another element, it may be parallel, or nearly parallel but not exactly parallel. For example, when sliceforms such as those described herein are in a collapsed state, each of the planar elements may be oriented such that they extend in nearly parallel directions, but not necessarily in exact parallel alignment with one another or with a panel of the foldable article.

Figure 1:
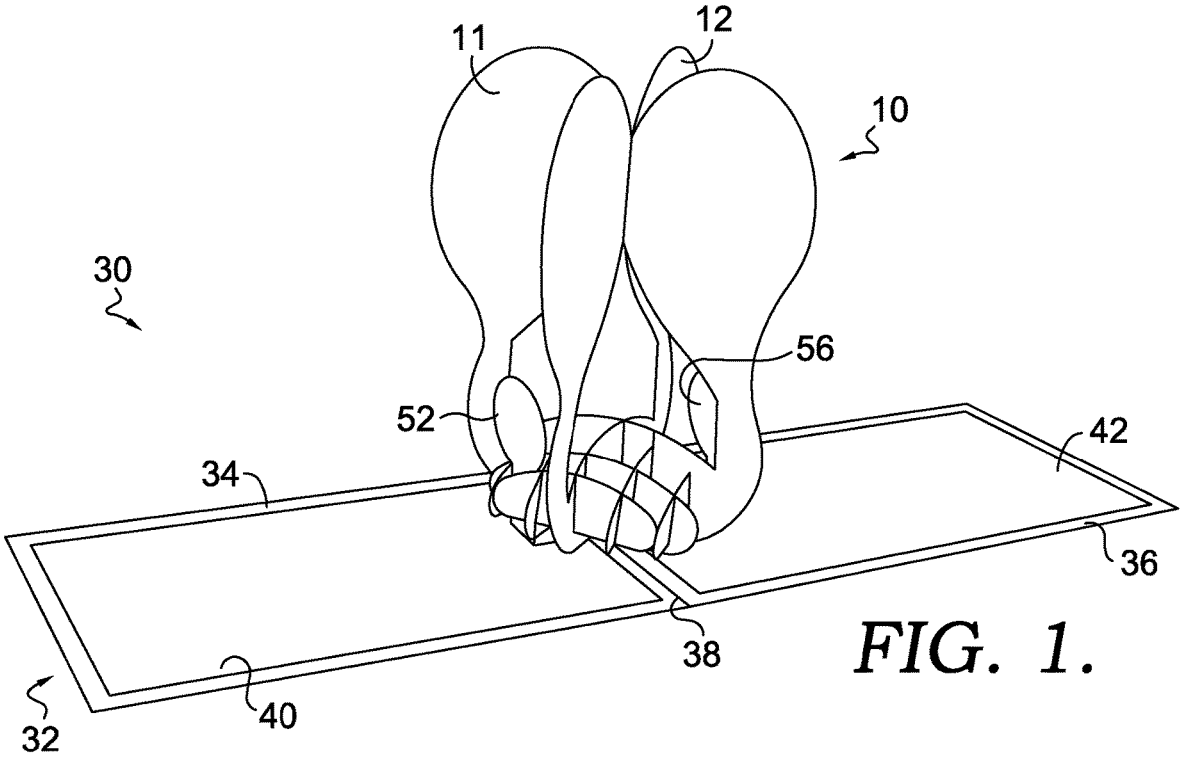

Sliceforms useful with the present invention generally include a plurality of cooperating panels that are configured to move between a first collapsed, substantially flat configuration and a second three-dimensional configuration. An example sliceform is illustrated in FIG. 1 and is generally designated with reference number 10. Sliceform 10 includes vertical panel 11, vertical panel 12, base panel 13, base panel 14, base panel 15, base panel 16, base panel 17, base panel 18, base panel 19, and base panel 20. The vertical panels 11 and 12 and the base panels 13, 14, 15, 16, 17, 18, 19, and 20 cooperate to form a grid-like structure. Generally, the base panels 13, 14, 15, 16, 17, 18, 19, and 20 provide a base above which the vertical panels 11 and 12 are supported. The vertical panels 11 and 12 may include decorative elements.

It is envisioned that any number of the panels comprising a sliceform (e.g., the sliceform 10) may be either vertical panels (e.g., vertical panels 11 and 12) or base panels (e.g., base panels 13, 14, 15, 16, 17, 18, 19, and 20). In other words, any ratio of vertical panels to base panels is contemplated within the scope of the present invention. In some aspects, all of the panels may be vertical panels (e.g., vertical panels 11 and 12). In other aspects, all of the panels may be base panels (e.g., base panels 13, 14, 15, 16, 17, 18, 19, and 20).

Figure 2:
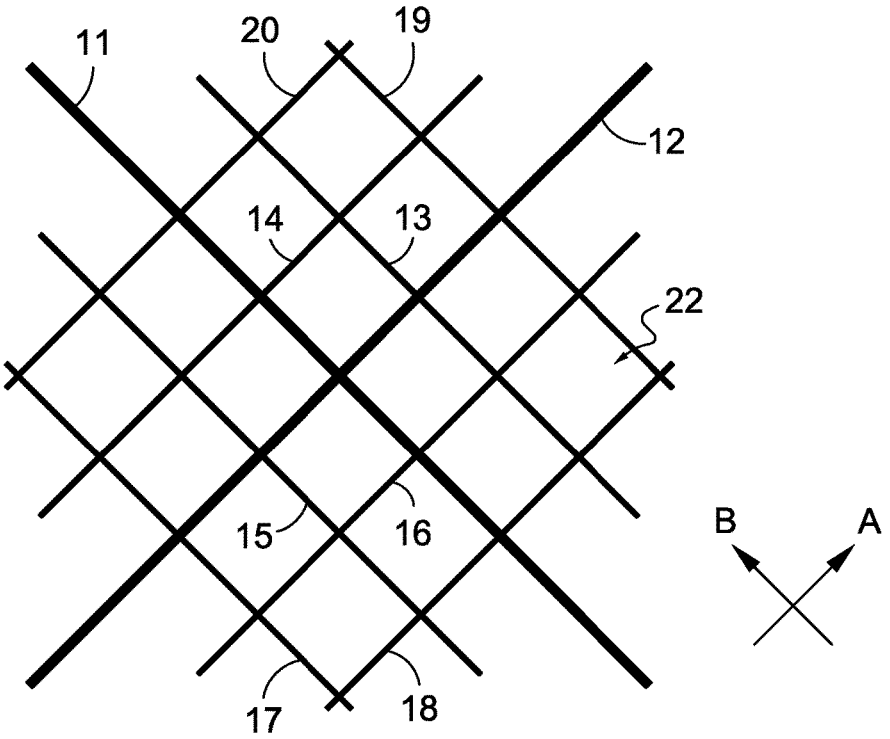

The grid-like structure of the sliceform 10 formed when the sliceform 10 is in the second three-dimensional configuration is shown in FIG. 2, which illustrates a top-view of the sliceform 10. A number of openings 22 in the grid-like structure of the sliceform 10 are apparent and are generally defined by adjacent and intersecting base panels (e.g., 13, 14, 15, 16, 17, 18, 19, and 20) and/or vertical panels (e.g., 11 and 12). In other words, the openings 22 may comprise passageways through the sliceform 10 that are formed when the sliceform 10 is in the second, three-dimensional configuration. In alternative aspects, however, the openings may comprise slits or other shaped apertures formed in one or more of the base panels 13, 14, 15, 16, 17, 18, 19, and 20 and/or the vertical panels 11 and 12. In these aspects, the tabs and retaining portions described below are inserted through the slits or other shaped aperture to removably secure the sliceform 10 to the foldable article.

When the sliceform 10 is in the second three-dimensional configuration, some of the panels extend in a first direction that is labeled as direction A in FIG. 2. Some of the other panels extend in a second direction that is labeled as direction B in FIG. 2. Direction A and direction B are illustrated as perpendicular to one another. In other aspects, however, direction A and direction B may not be perpendicular so long as such directions intersect (i.e., are not parallel) with each other.

Figure 3:
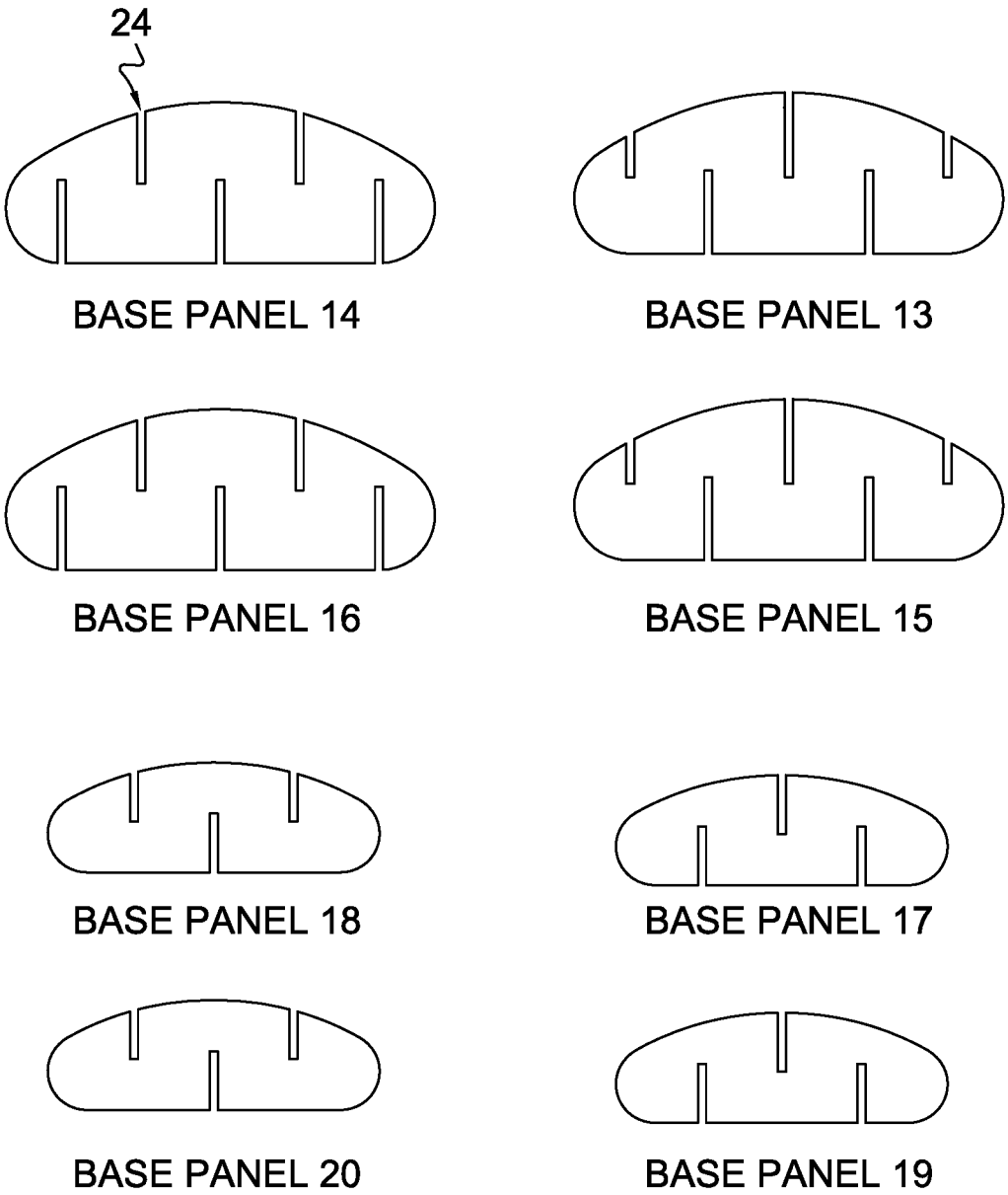
Figure 4:
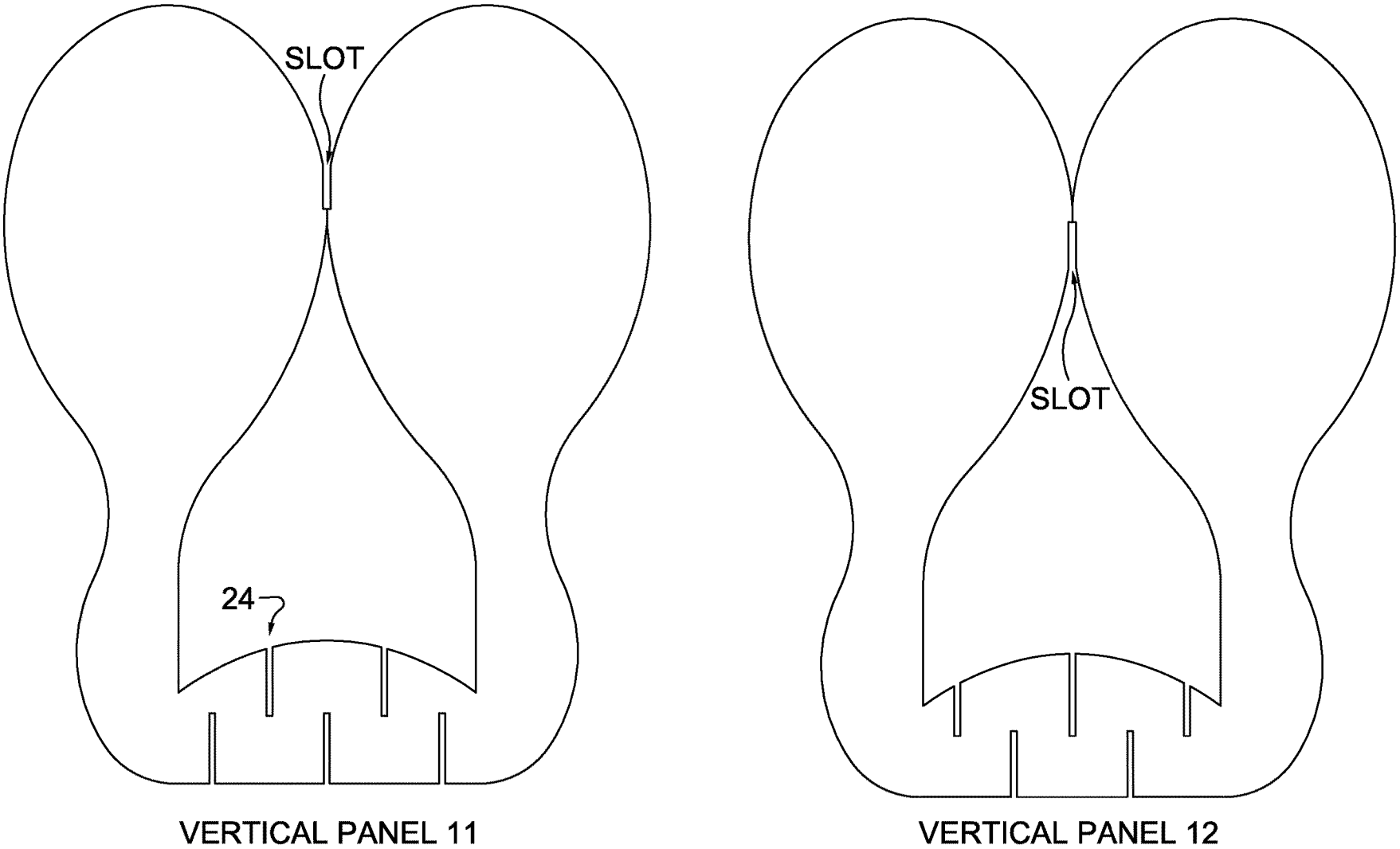

The base panels 13, 14, 15, 16, 17, 18, 19, and 20 and the vertical panels 11 and 12 include slots 24 formed therein. Turning to FIGS. 3 and 4, the slots 24 of each of the base panels 13, 14, 15, 16, 17, 18, 19, and 20 and the vertical panels 11 and 12 of the sliceform 10 are illustrated. These slots allow all of the panels to cooperate and permit the sliceform 10 to move between the first collapsed, substantially flat configuration and the second three-dimensional configuration.

Returning to FIG. 1, the sliceform 10 is shown removably secured to a foldable article 30. In the illustrated aspect, the foldable article 30 is a greeting card. It is envisioned, however, that any type of foldable article is suitable for the present invention. For example, the concepts of the present invention could equally be applied to other products that contain two hinged planes that move toward and away from one another, for example, books, invitations, boxes, and other objects with flaps.

Figure 5:
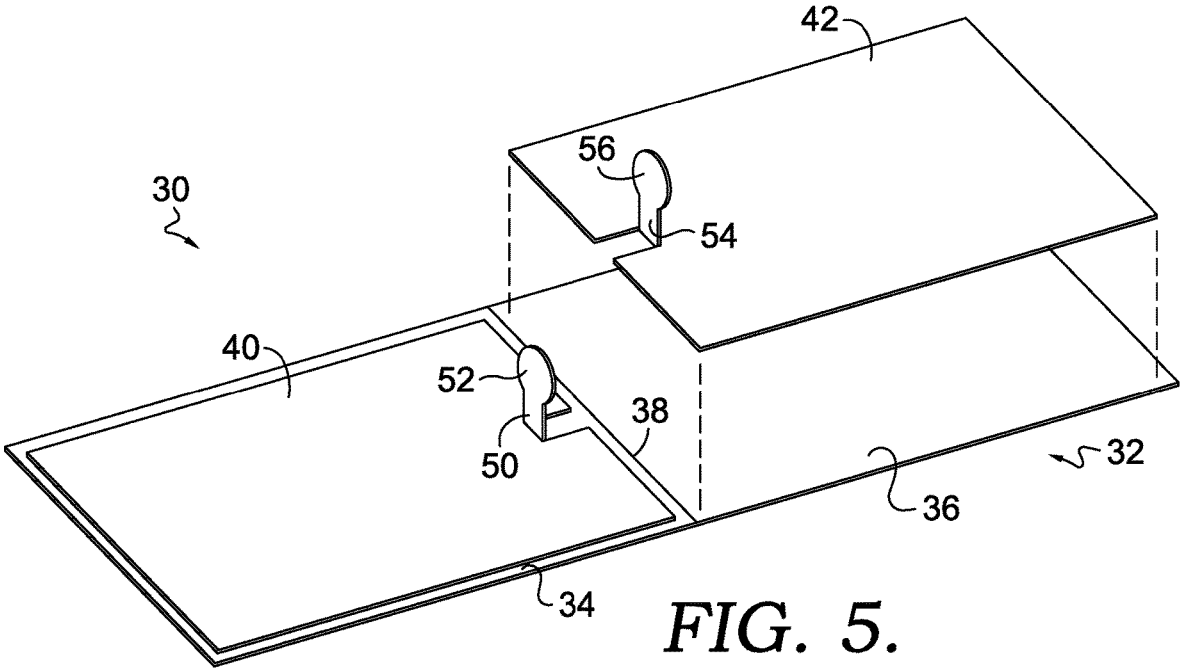

The foldable article 30 illustrated in FIG. 1 includes a panel 32 having a first subpanel 34 separated from a second subpanel 36 by a fold 38. As shown in FIG. 5, a third subpanel 40 is affixed to the first subpanel 34. A fourth subpanel 42 is shown lifted away from the second subpanel 36, but may likewise be affixed thereto. In the illustrated aspect, the third subpanel 40 and the fourth subpanel 42 are discrete pieces affixed to the first subpanel 34 and the second subpanel 36, respectively.

Figure 6:
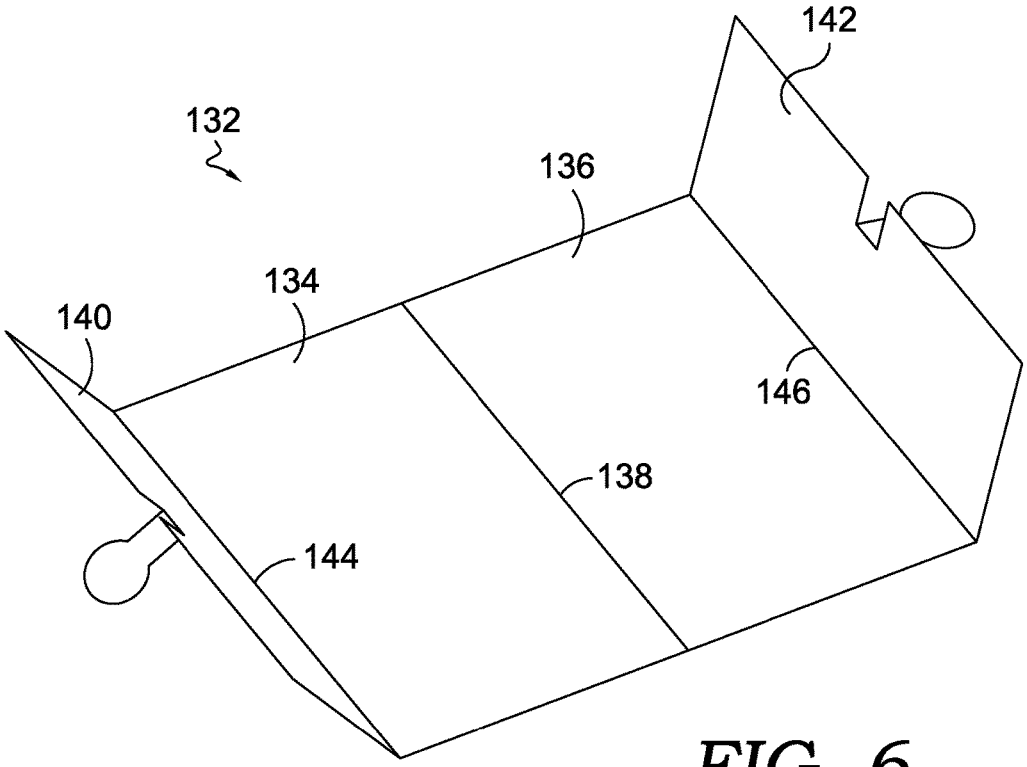

In an alternative embodiment illustrated in FIG. 6, however, the panel 132 has a third subpanel 140 joined to the first subpanel 134 opposite the second subpanel 136. Likewise, the panel 132 has a fourth subpanel 142 joined to the second subpanel 136 opposite the first subpanel 134. In the alternative embodiment of FIG. 6, the third subpanel 140 is separated from the first subpanel 134 by a second fold 144 and the fourth subpanel 142 is separated from the second subpanel 136 by a third fold 146. The panel 132 may be assembled by first folding the third subpanel 140 over the second fold 144 and then affixing the third subpanel 140 to the first subpanel 134. Similarly, the fourth subpanel 142 may be first folded over the third fold 146 before then affixing the fourth subpanel 142 to the second subpanel 136.

Figure 7:
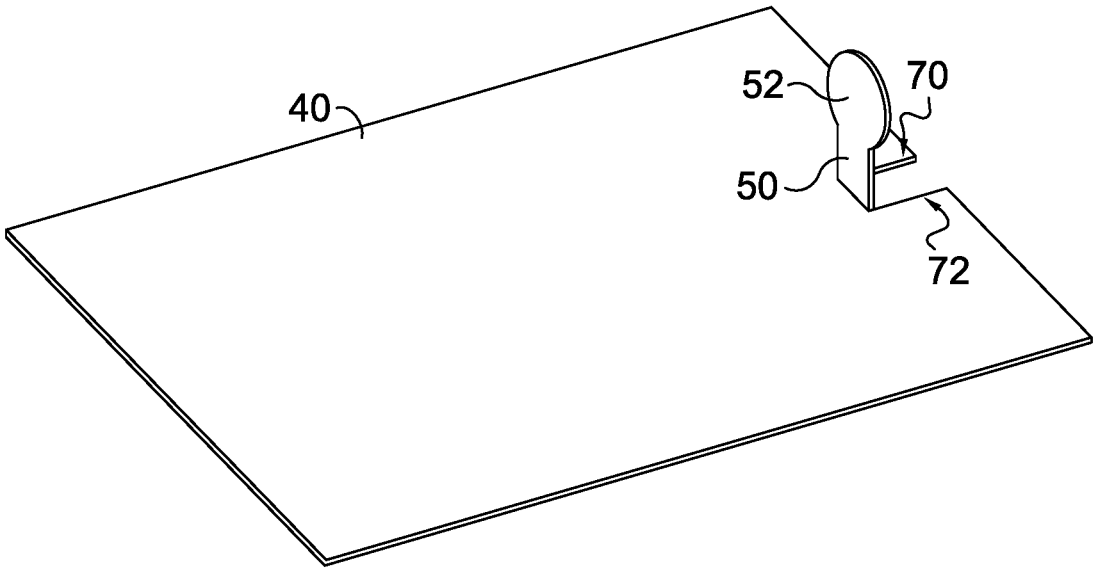

Turning now to FIG. 7, a detailed view of the third subpanel 40 of the panel 32 is illustrated. For the sake of brevity, the following description will only discuss aspects of the third subpanel 40. This discussion, however, applies equally to the fourth subpanel 42 unless specifically noted otherwise.

In FIG. 7, the third subpanel 40, includes a first tab 50 having a first retaining portion 52. In the illustrated aspect, the first retaining portion 52 is integrally formed with the first tab 50. The first retaining portion 52 is wider than the first tab 50. In some aspects, the third subpanel 40 may be die cut from a larger article. The die cutting may result in the removal of excess material and also in the cuts between the first tab 50 and the edges 70 and 72. These cuts allow the first tab 50 to move between a first position (not shown) where the first tab 50 is flush with the third subpanel 40 and a second position (shown in FIG. 7) where the first tab 50 is perpendicular to the third subpanel 40. In this way, the first tab 50 and the first retaining portion 52 may be formed without the need for adhesives or other affixing means.

Figure 8:
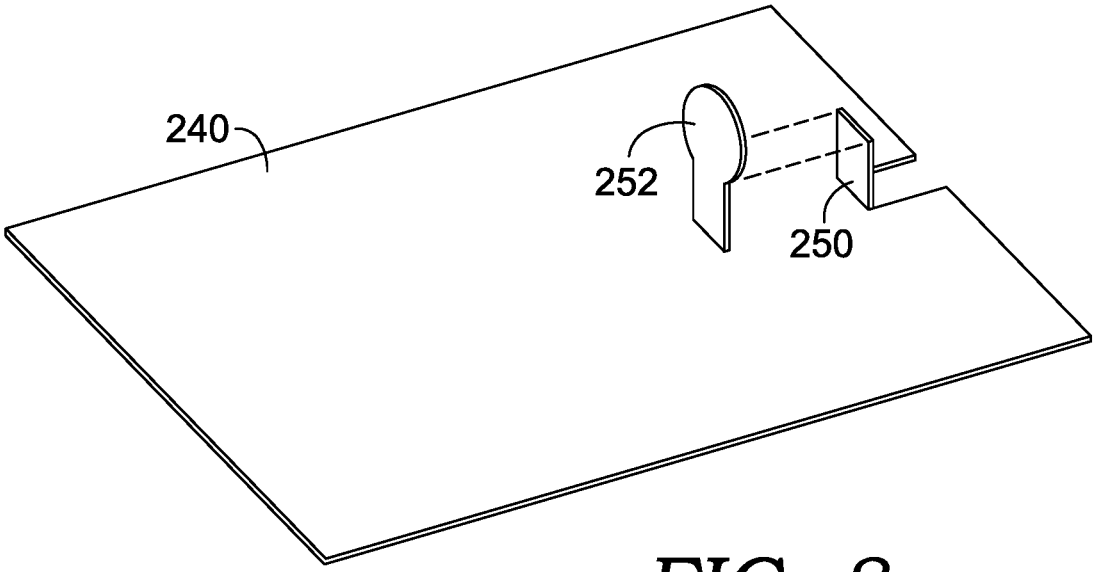

In an alternative embodiment illustrated in FIG. 8, a tab 250 is formed in a third subpanel 240 separately from a retaining portion 252. In this alternative embodiment, two equal cuts in the third subpanel 240 may form the tab 250. Further, the retaining portion 252 may then be affixed (e.g., with an adhesive, taping, etc.) to the tab 250 to form a unitary tab and retaining portion. In this way, less material may be used and less material may be wasted as compared with die cutting excess material away from a rectangular sheet.

Returning to FIG. 5, the fourth subpanel 42 includes a second tab 54 and a second retaining portion 56. The third subpanel 40 is oriented with the first tab 50 proximate the fold 38. Likewise, the fourth subpanel 42 is oriented with the second tab 54 proximate the fold 38.

Figure 9:
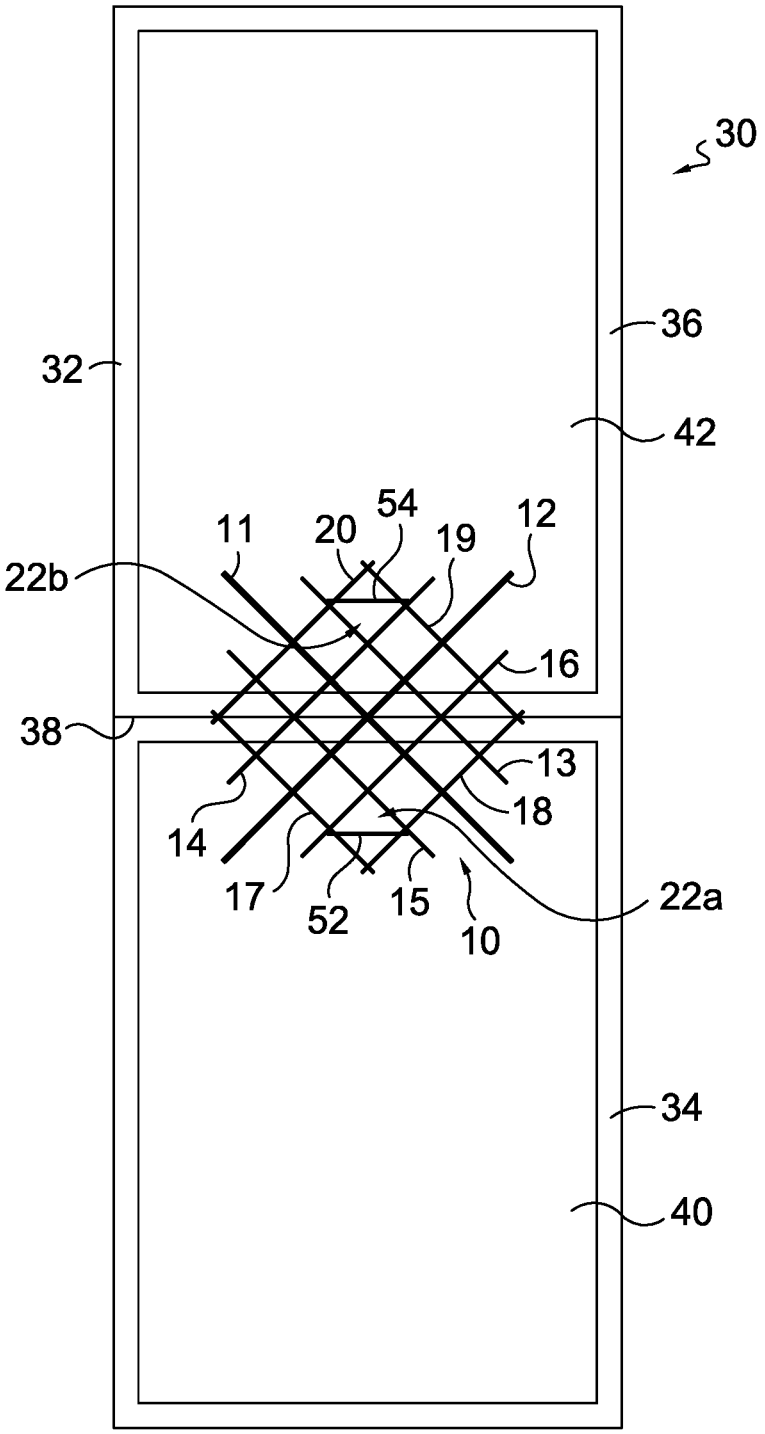

Turning now to FIG. 9 and with continued reference to FIG. 1, the sliceform 10 is removably secured to the panel 32 by the first tab 50 and second tab 54. More specifically, the first tab 50 and the first retaining portion 52 have been threaded through a first opening 22*a* in the sliceform 10. The first retaining portion 52 is sized to be wider than the first opening 22*a*, thus preventing movement of the sliceform 10 away from the panel 32. Thus, a top edge of the sliceform elements 17 and 18 is positioned beneath a bottom edge of the first retaining portion 52. In some aspects, the first tab 50 is sized to be approximately the same width as the first opening 22*a* when the sliceform 10 is in the second three-dimensional configuration.

Similarly, the second tab 54 and the second retaining portion 56 have been threaded through a second opening 22*b* in the sliceform 10. The second retaining portion 56 is sized to be wider than the second opening 22*b*, thus preventing movement of the sliceform 10 away from the panel 32. Thus, a top edge of the sliceform elements 19 and 20 is positioned beneath a bottom edge of the second retaining portion 56. In some aspects, the second tab 54 is sized to be approximately the same width as the second opening 22*b* when the sliceform 10 is in the second three-dimensional configuration. In some aspects, the first retaining portion 52 may be threaded through the first opening 22*a* by manipulating the size thereof (e.g., by bending the first retaining portion 52 to a size less than the width of the first opening 22*a*). The second retaining portion 56 may be similarly manipulated to fit through the second opening 22*b*.

Figure 10:
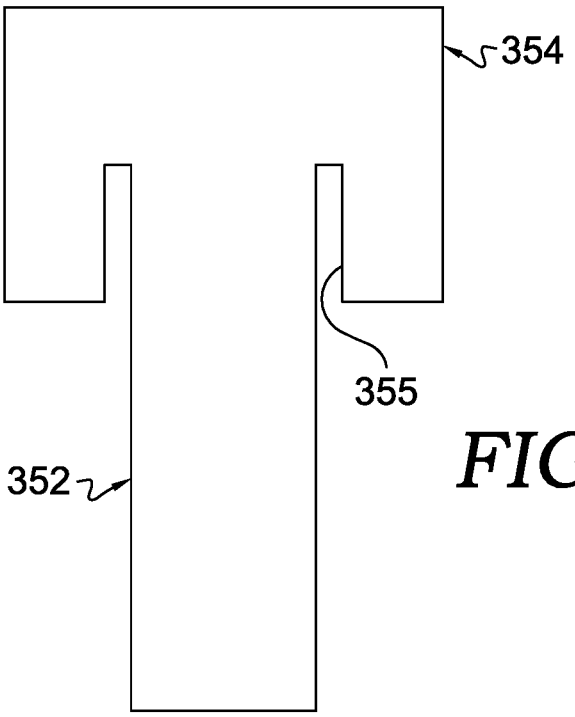
FIG. 10 is a top view of an alternative aspect of a first tab and a first retaining portion, in accordance with an embodiment of the present invention.
Figure 11:
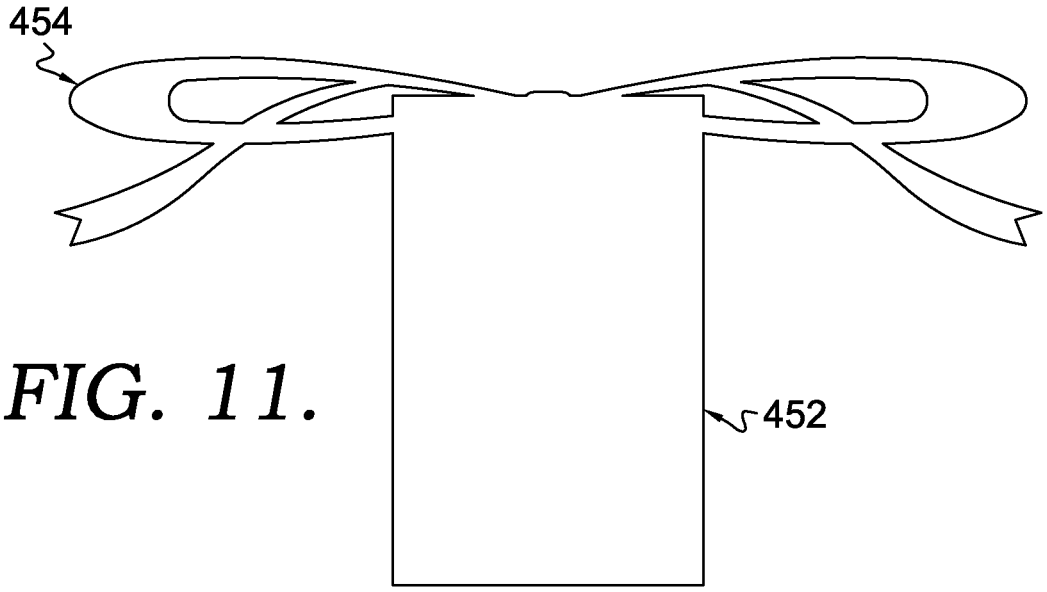
FIG. 11 top view of another alternative aspect of a first tab and a first retaining portion, in accordance with an embodiment of the present invention.

Alternative aspects of the first tab and the first retaining portion are illustrated in FIGS. 10 and 11. For the sake of brevity, the following description will only discuss aspects of the first tab and the first retaining portion. The discussion of these aspects, however, applies equally to the second tab and the second retaining portion unless specifically noted otherwise.

FIG. 10 illustrates one aspect of a first tab 352 having a first retaining portion 354 and a first pair of slots 355 formed in the first retaining portion 354. As a result, the first tab 352 has a "T" shape. In some aspects, one or more of the panels comprising the sliceform may be received in the either or both of the first pair of slots 355. For example, the sliceform 10 may be secured to the foldable article 30 by the first tab 352 extending through the first passageway 22*a* and the first retaining portion 354 extending above panels 17 and 18 of the sliceform. Continuing with this example, one of the panels 17 and 18 may be received in each slot of the first pair of slots 355. In some aspects, the panels 17 and 18 may have reciprocal slots aligned with the first pair of slots 355 such that a portion of the sliceform is received in the first pair of slots and a portion of the first retaining portion 354 is received in the slots of the sliceform panels. These aspects may allow the tab and retaining portion to secure the sliceform to the foldable article without the tab and retaining portion having to extend beyond the sliceform (e.g., the tab and retaining portion could have the same, or even a shorter, height above the foldable article than the sliceform elements being secured).

FIG. 11 illustrates another aspect of a first tab 452 having a first retaining portion 454. In this aspect, the first tab 452 and the first retaining portion 454 comprise a decorative element (e.g., a gift box with a ribbon). Thus, one or both of the first tab and the first retaining portion may include features that are functional for securing the sliceform to the foldable article while also providing the designer additional design options.

Some aspects of this disclosure have been described with respect to the illustrative examples provided by FIGS. 1-11. Additional aspects of the disclosure will now be described that may be related to subject matter included in one or more claims of this application, or one or more related applications, but the claims are not limited to only the subject matter described in the below portions of this description. These additional aspects may include features illustrated by FIGS. 1-11, features not illustrated by FIGS. 1-11, and any combination thereof. When describing these additional aspects, reference may or may not be made to elements depicted by FIGS. 1-11.

One aspect disclosed herein is generally directed to a foldable article comprising a panel having a sliceform removably secured thereto. The panel may have first subpanel and a second subpanel. The first subpanel and the second subpanel may be separated by a fold in the panel. A first retaining portion may be coupled to the first subpanel. A second retaining portion may be coupled to the second subpanel. A sliceform may be moveably coupled to the panel by the first retaining portion and the second retaining portion such that the sliceform is moveable between a first collapsed, substantially flat configuration and a second three-dimensional configuration. The sliceform may be in the first collapsed, substantially flat configuration when the panel is folded closed along the fold. The sliceform may be in the second three-dimensional configuration when the panel is unfolded and open.

In some aspects, the foldable article may further comprise a third subpanel having a first tab and affixed to the first subpanel such that the first tab is proximate the fold, a fourth subpanel having a second tab and affixed to the second subpanel such that the second tab is proximate the fold. Each of the first tab and the second tab may be configured to move between a flat position where said tab is flush with said subpanel and a raised position where said tab is perpendicular to said subpanel. The first retaining portion may be coupled to the first tab. The second retaining portion may be coupled to the second tab. A first width of the first retaining portion may be wider than the first tab. A second width of the second retaining portion may be wider than the second tab.

In other aspects, the sliceform may comprise a plurality of first base panels and a plurality of second base panels. When the sliceform is in the second three-dimensional configuration, each of the plurality of first base panels may be orthogonal to both of the panel and each of the plurality of second base panels.

In yet other aspects, when the sliceform is in the second three-dimensional configuration, the plurality of first base panels may cooperate with the plurality of second base panels to form a grid. The first retaining portion may extend through a first opening in the grid. The second retaining portion may extend through a second opening in the grid. The first width of the first retaining portion may be wider than the first opening, wherein the second width of the second retaining portion is wider than the second opening.

In some aspects, the sliceform may further comprise a first vertical panel and a second vertical panel. When the sliceform is in the second three-dimensional configuration, the first vertical panel may be parallel to the first plurality of base panels and the second vertical panel may be parallel to the second plurality of base panels. The first vertical panel may extend beyond a top of each of the first plurality of base panels. The second vertical panel may extend beyond a top of each of the second plurality of base panels.

Another aspect disclosed herein is generally directed to a method of removably securing a sliceform to a foldable article. The method may include: providing a panel having a fold separating a first subpanel from a second subpanel, forming a first tab on a third subpanel, wherein the first tab includes a first retaining portion, forming a second tab on a fourth subpanel, wherein the second tab includes a second retaining portion, affixing the third subpanel to the first subpanel such that the first tab is proximate the fold, affixing the fourth subpanel to the second subpanel such that the second tab is proximate the fold, providing a sliceform that is moveable between a first collapsed, substantially flat configuration and a second three-dimensional configuration, wherein the sliceform includes a plurality of base panels that cooperate to form a vertical grid having a plurality of openings, including a first opening and a second opening, when the sliceform is in the second three-dimensional configuration, and placing the sliceform on the panel while the panel is in an open position and oriented such that the first tab extends through the first opening and the second tab extends through the second opening, wherein the first retaining portion has a first width that is wider than the first opening, wherein the second retaining portion has a second width that is wider than the second opening.

In some aspects, the third subpanel may be joined to the first subpanel opposite the second subpanel, the third subpanel being separated from the first subpanel by a second fold. The fourth subpanel may be joined to the second subpanel opposite the first subpanel, the fourth subpanel being separated from the second subpanel by a third fold. The third subpanel may be affixed to the first subpanel after the third subpanel has been folded over on the first subpanel across the second fold. The fourth subpanel may be affixed to the second subpanel after the fourth subpanel has been folded over on the second subpanel across the third fold. Forming a first tab may comprise making two equal cuts in the free end of the third subpanel opposite of, and towards, the first subpanel. Forming a second tab may comprise making two equal cuts in the free end of the fourth subpanel opposite of, and towards, the second subpanel. The first tab may be moveable between a first position flush with the third subpanel and a second position perpendicular to the third subpanel. The second tab may be moveable between a third position flush with the fourth subpanel and a fourth position perpendicular to the fourth subpanel.

In other aspects, the first retaining portion may be secured to the first tab with an adhesive and the second retaining portion may be secured to the second tab with an adhesive. The first retaining portion may also be integral to the first tab and the second retaining portion may also be integral to the second tab. Forming the first tab on the third subpanel may comprise die cutting the first tab and the first retaining portion from the third subpanel and forming the second tab on the fourth subpanel may comprise die cutting the second tab and the second retaining portion from the fourth subpanel.

In yet other aspects, each of the plurality of base panels may be orthogonal to the panel when the panel is in the open position and the sliceform is in the second three-dimensional configuration. The sliceform also may include one or more vertical panels that cooperate with the plurality of base panels to further define the vertical grid. The one or more vertical panels may extend farther from the panel than a most distal portion of the plurality of base panels when the sliceform is in the second three-dimensional configuration.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and sub combinations are of utility and may be employed without reference to other features and sub combinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A foldable article comprising:

a panel having a first subpanel and a second subpanel, the first subpanel and the second subpanel being separated by a fold in the panel;

a first retaining portion coupled to the first subpanel;

a second retaining portion coupled to the second subpanel;

a sliceform moveably coupled to the panel by the first retaining portion and the second retaining portion such that the sliceform is moveable between a first collapsed, substantially flat configuration and a second three-dimensional configuration, wherein the sliceform is in the first collapsed, substantially flat configuration when the panel is folded closed along the fold, wherein the sliceform is in the second three-dimensional configuration when the panel is unfolded and open;

a third subpanel having a first tab and affixed to the first subpanel such that the first tab is proximate the fold, a fourth subpanel having a second tab and affixed to the second subpanel such that the second tab is proximate the fold; and each of the first tab and the second tab configured to move between a flat position where said tab is flush with said subpanel and a raised position where said tab is perpendicular to said subpanel, wherein the first retaining portion is coupled to the first tab, wherein the second retaining portion is coupled to the second tab.

2. The foldable article of claim 1, wherein a first width of the first retaining portion is wider than the first tab, wherein a second width of the second retaining portion is wider than the second tab.

3. The foldable article of claim 2, wherein the sliceform comprises:

a plurality of first base panels; and a plurality of second base panels, wherein when the sliceform is in the second three-dimensional configuration, each of the plurality of first base panels is orthogonal to both of the panel and each of the plurality of second base panels.

4. The foldable article of claim 3, wherein when the sliceform is in the second three-dimensional configuration, the plurality of first base panels cooperate with the plurality of second base panels to form a grid, wherein the first retaining portion extends through a first opening in the grid, wherein the second retaining portion extends through a second opening in the grid.

5. The foldable article of claim 4, wherein the first width of the first retaining portion is wider than the first opening, wherein the second width of the second retaining portion is wider than the second opening.

6. The foldable article of claim 3, wherein the sliceform further comprises:

a first vertical panel; and a second vertical panel, wherein when the sliceform is in the second three-dimensional configuration, the first vertical panel is parallel to the first plurality of base panels and the second vertical panel is parallel to the second plurality of base panels.

7. The foldable article of claim 6, wherein the first vertical panel extends beyond a top of each of the first plurality of base panels, wherein the second vertical panel extends beyond a top of each of the second plurality of base panels.

8. A method of removably securing a sliceform to a foldable article, the method comprising:

providing a panel having a fold separating a first subpanel from a second subpanel;

forming a first tab on a third subpanel, wherein the first tab includes a first retaining portion;

forming a second tab on a fourth subpanel, wherein the second tab includes a second retaining portion;

affixing the third subpanel to the first subpanel such that the first tab is proximate the fold;

affixing the fourth subpanel to the second subpanel such that the second tab is proximate the fold;

providing a sliceform that is moveable between a first collapsed, substantially flat configuration and a second three-dimensional configuration, wherein the sliceform includes a plurality of base panels that cooperate to form a vertical grid having a plurality of openings, including a first opening and a second opening, when the sliceform is in the second three-dimensional configuration; and placing the sliceform on the panel while the panel is in an open position and oriented such that the first tab extends through the first opening and the second tab extends through the second opening, wherein the first retaining portion has a first width that is wider than the first opening, wherein the second retaining portion has a second width that is wider than the second opening.

9. The method of claim 8, wherein the third subpanel is joined to the first subpanel opposite the second subpanel, the third subpanel being separated from the first subpanel by a second fold, wherein the fourth subpanel is joined to the second subpanel opposite the first subpanel, the fourth subpanel being separated from the second subpanel by a third fold.

10. The method of claim 9, wherein the third subpanel is affixed to the first subpanel after the third subpanel has been folded over on the first subpanel across the second fold, wherein the fourth subpanel is affixed to the second subpanel after the fourth subpanel has been folded over on the second subpanel across the third fold.

11. The method of claim 9, wherein forming a first tab comprises making two equal cuts in the free end of the third subpanel opposite of, and towards, the first subpanel, wherein forming a second tab comprises making two equal cuts in the free end of the fourth subpanel opposite of, and towards, the second subpanel.

12. The method of claim 11, wherein the first tab is moveable between a first position flush with the third subpanel and a second position perpendicular to the third subpanel, wherein the second tab is moveable between a third position flush with the fourth subpanel and a fourth position perpendicular to the fourth subpanel.

13. The method of claim 8, wherein the first retaining portion is secured to the first tab with an adhesive, wherein the second retaining portion is secured to the second tab with an adhesive.

14. The method of claim 8, wherein the first retaining portion is integral to the first tab, wherein the second retaining portion is integral to the second tab.

15. The method of claim 14, wherein forming the first tab on the third subpanel comprises die cutting the first tab and the first retaining portion from the third subpanel, wherein forming the second tab on the fourth subpanel comprises die cutting the second tab and the second retaining portion from the fourth subpanel.

16. The method of claim 8, wherein each of the plurality of base panels is orthogonal to the panel when the panel is in the open position and the sliceform is in the second three-dimensional configuration.

17. The method of claim 8, wherein the sliceform also includes one or more vertical panels that cooperate with the plurality of base panels to further define the vertical grid, wherein the one or more vertical panels extend farther from the panel than a most distal portion of the plurality of base panels when the sliceform is in the second three-dimensional configuration.

* * * * *